US005197296A

United States Patent [19]

Prosser et al.

[11] Patent Number: 5,197,296

[45] Date of Patent: Mar. 30, 1993

[54] CRYOGENIC RECTIFICATION SYSTEM FOR PRODUCING ELEVATED PRESSURE PRODUCT

[75] Inventors: Neil M. Prosser, East Amherst; Mark J. Roberts, North Tonawanda, both of N.Y.

[73] Assignee: Praxair Technology, Inc., Danbury, Conn.

[21] Appl. No.: 823,685

[22] Filed: Jan. 21, 1992

[51] Int. Cl.[5] ..... F25J 3/00

[52] U.S. Cl. ..... 62/39; 62/18; 62/22

[58] Field of Search ..... 62/38, 39, 18, 22

[56] References Cited

U.S. PATENT DOCUMENTS

| | | | |
|---|---|---|---|
| 2,666,303 | 1/1954 | Schuftan | 62/123 |
| 3,258,930 | 7/1966 | Jakob | 62/39 |
| 3,260,056 | 7/1966 | Becker | 62/38 |
| 3,327,488 | 6/1967 | Pervier | 62/39 |
| 3,447,331 | 6/1969 | Smith | 62/13 |
| 4,367,082 | 1/1983 | Tomisaka et al. | 62/38 |
| 4,557,735 | 12/1985 | Pike | 55/26 |
| 4,746,343 | 5/1988 | Ishizu et al. | 62/38 |
| 4,783,209 | 11/1988 | Erickson | 62/22 |
| 4,871,382 | 10/1989 | Thorogood et al. | 62/18 |
| 4,936,099 | 6/1990 | Woodward et al. | 62/24 |
| 4,964,901 | 10/1990 | Rhode | 62/13 |
| 4,994,098 | 2/1991 | Agrawal et al. | 62/22 |
| 5,036,672 | 8/1991 | Rottmann | 62/24 |
| 5,074,898 | 12/1991 | Cheung | 62/38 |

*Primary Examiner*—Ronald C. Capossela
*Attorney, Agent, or Firm*—Stanley Ktorides

[57] ABSTRACT

A cryogenic rectification system for producing elevated pressure product wherein the lower pressure column of a two column system is operated at elevated pressure and nitrogen-containing fluid taken from the upper portion of the lower pressure column is used to generate plant refrigeration and to regenerate feed purifier adsorbent beds thus avoiding the need for any feed expansion.

16 Claims, 4 Drawing Sheets

CRYOGENIC RECTIFICATION SYSTEM FOR PRODUCING ELEVATED PRESSURE PRODUCT

TECHNICAL FIELD

This invention relates generally to the cryogenic rectification of mixtures comprising oxygen and nitrogen, e.g. air, and more particularly to the production of elevated pressure product from the cryogenic rectification.

BACKGROUND ART

The cryogenic separation of mixtures such as air to produce oxygen and/or nitrogen is a well established industrial process. Liquid and vapor are passed in countercurrent contact through one or more columns and the difference in vapor pressure between the oxygen and nitrogen causes nitrogen to concentrate in the vapor and oxygen to concentrate in the liquid. The lower the pressure is in the separation column, the easier is the separation into oxygen and nitrogen due to vapor pressure differential. Accordingly, the final separation into product oxygen and/or nitrogen is generally carried out at a relatively low pressure, usually just a few pounds per square inch (psi) above atmospheric pressure.

Often the product oxygen and/or nitrogen is desired at an elevated pressure. In such situations, the product is compressed to the desired pressure in a compressor. This compression is costly in terms of energy costs as well as capital costs for the product compressors.

Accordingly, it is an object of this invention to provide an improved cryogenic rectification system for the production of oxygen and/or nitrogen.

It is a further object of this invention to provide an improved cryogenic rectification system for the production of oxygen and/or nitrogen wherein oxygen and/or nitrogen may be produced at elevated pressure thereby eliminating or reducing the need for product gas compression.

SUMMARY OF THE INVENTION

The above and other objects which will become apparent to one skilled in the art upon a reading of this disclosure are attained by the present invention one aspect of which is:

A cryogenic rectification method for producing elevated pressure product comprising:

(A) passing a feed comprising oxygen and nitrogen through a purifier adsorbent bed and removing adsorbable contaminants from the feed to the bed to produce clean feed;

(B) cooling the clean feed, passing the cooled, clean feed into a high pressure column, and separating the feed by cryogenic rectification into nitrogen-enriched and oxygen-enriched fluids;

(C) passing nitrogen-enriched and oxygen-enriched fluids from the high pressure column into an elevated pressure column operating at a pressure less than that of the high pressure column but at least 20 psia, and producing nitrogen-rich and oxygen-rich fluids by cryogenic rectification in the elevated pressure column;

(D) removing nitrogen-containing fluid from the upper portion of the elevated pressure column, turboexpanding the nitrogen-containing fluid to generate refrigeration, and passing the resulting nitrogen-containing fluid in indirect heat exchange with the feed to cool the feed;

(E) passing nitrogen-containing fluid from the elevated pressure column through the purifier adsorbent bed to regenerate the bed; and (F) recovering at least one of the nitrogen-rich and oxygen-rich fluids from the elevated pressure column as elevated pressure product.

Another aspect of the invention comprises:

A cryogenic rectification apparatus comprising:

(A) a purifier adsorbent bed, a primary heat exchanger, and means for passing feed from the purifier adsorbent bed to the primary heat exchanger;

(B) a column system comprising a first column and a second column, means for passing feed from the primary heat exchanger into the first column and means for passing fluid from the first column into the second column;

(C) means for withdrawing fluid from the upper portion of the second column;

(D) a turboexpander, means for passing fluid withdrawn from the upper portion of the second column to the turboexpander, and means for passing expanded fluid from the turboexpander through the primary heat exchanger;

(E) means for passing fluid withdrawn from the upper portion of the second column to the purifier adsorbent bed; and (F) means for recovering product fluid from the second column.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150 degrees K.

As used herein, the term "indirect heat exchange" means the bringing of two fluid streams into heat exchange relation without any physical contact or intermixing of the fluids with each other.

As used herein, the term "argon column" means a system comprising a column and a top condenser which processes a feed comprising argon and produces a product having an argon concentration which exceeds that of the feed. As used herein, the term "upper portion" of the elevated pressure or second column means the upper half of the column and preferably is the portion of the column above the point where oxygen- enriched fluid is passed into that column.

As used herein, the term "packing" means any solid or hollow body of predetermined configuration, size and shape used as column internals to provide surface area for the liquid to allow mass transfer at the liquid-vapor interface during countercurrent flow of the two phases.

As used herein, the term "structured packing" means packing wherein individual members have specific orientation relative to each other and to the column axis.

As used herein, the term "turboexpansion" means the flow of high pressure gas through a turbine to reduce the pressure and temperature of the gas and thereby produce refrigeration. A loading device such as a generator, dynamometer or compressor is typically used to recover the energy.

As used herein, the term "purifier adsorbent bed" means a media that removes carbon dioxide and moisture as well as trace hydrocarbons from the feed stream by means of absorption. The media is contained in two or more parallel beds.

DETAILED DESCRIPTION

The invention is a cryogenic rectification system wherein product is produced at elevated pressure from an elevated pressure column. An elevated pressure stream from the upper portion of the column is turboexpanded to provide plant refrigeration. Thus, all of the feed can be retained at high pressure and passed as such into a high pressure column for the first separation. Fluid from the column, by virtue of its elevated pressure, is also used to regenerate adsorbent bed purifiers.

The invention will be described in greater detail with reference to the Drawings.

Figure 1:
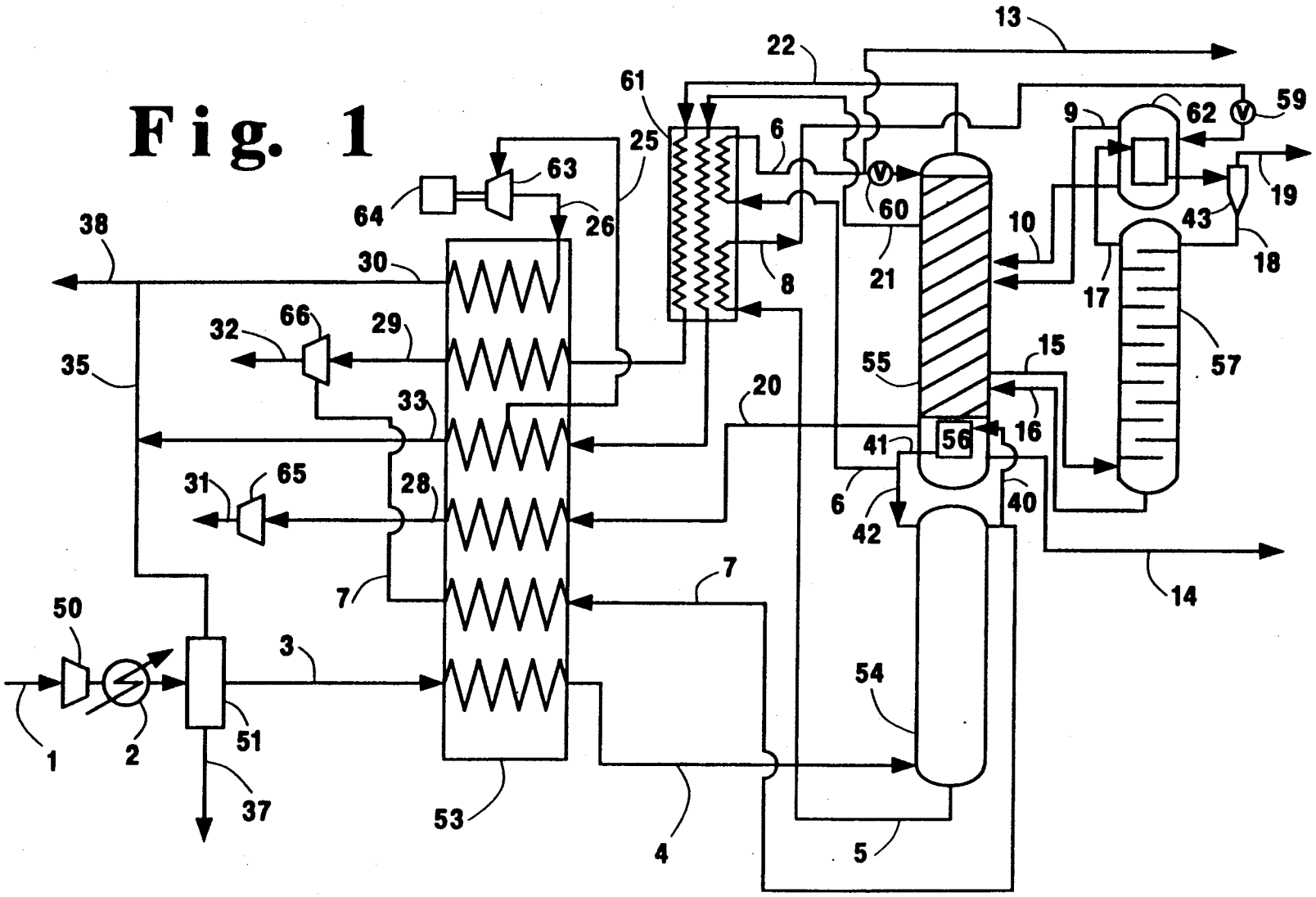
FIG. 1 is a schematic flow diagram of one preferred embodiment of the invention.

Referring now to FIG. 1, a feed 1 comprising oxygen and nitrogen, such as air, is compressed by passage through compressor 50, cooled through cooler 2 to remove the heat of compression and then passed through purifier adsorbent bed 51 wherein adsorbable impurities such as water vapor, carbon dioxide and trace hydrocarbons are removed from the feed and adsorbed onto the adsorbent bed particles. For the purpose of clarity, FIG. 1 shows a single adsorbent bed. In actual practice, two or more adsorbent beds would be employed wherein one bed would be purifying the feed while another bed would be undergoing regeneration. Thereafter the flows to the beds would be changed by appropriate valving so that the regenerated bed purifies the feed while the contaminated bed is regenerated. Generally, the adsorbent used is molecular sieve such as zeolite 13x or combinations of 13x and alumina or the like.

Clean, high pressure feed 3 is passed by conduit means from adsorbent bed 51 to primary heat exchanger 53 wherein the clean feed is cooled by indirect heat exchange with return streams, including a defined turboexpanded stream, as will be discussed in greater detail later. The clean, cooled, high pressure feed 4 is passed into first or high pressure column 54 which is the higher pressure column of a double column system and is operating at a pressure generally within the range of from 95 to 250 pounds per square inch absolute (psia). Within high pressure column 54, the feed is separated by cryogenic rectification into nitrogen-enriched vapor and oxygen-enriched liquid.

Oxygen-enriched liquid is removed from high pressure column 54 and is passed into second or elevated pressure column 55 which is the lower pressure column of the double column system. In the embodiment illustrated in FIG. 1, there is also included an argon column 57 and the oxygen-enriched liquid is employed to drive the argon column top condenser prior to passage into elevated pressure column 55. Oxygen-enriched liquid is withdrawn from column 54 as stream 5, cooled by passage through heat exchanger 61 and then passed as stream 8 through valve 59 and into argon column top condenser 62 wherein it is partially vaporized against condensing argon column top vapor. Resulting oxygen-enriched vapor and remaining oxygen-enriched liquid are passed as streams 9 and 10 respectively into column 55.

Nitrogen-enriched vapor 40 is removed from column 54 and is passed into double column main condenser 56 wherein it is condensed against reboiling column 55 bottoms. A portion 7 of nitrogen-enriched vapor 40 may be recovered as product high pressure nitrogen such as is shown in FIG. 1 wherein portion 7 is warmed by passage through primary heat exchanger 53 and, if desired, further compressed by compressor 66 prior to recovery as stream 32. Nitrogen-enriched liquid 41 is removed from main condenser 56, a portion 42 is returned to column 54 as reflux, and another portion 6 is cooled by passage through heat exchanger 61 and passed through valve 70 into elevated pressure column 55 to reflux the column. A portion 13 may be recovered as liquid nitrogen product.

Elevated pressure column 55 is operating at a pressure less than that at which column 54 is operating, but at a pressure of at least 20 psia and generally within the range of from 25 to 90 psia. In this way, the products produced by column 55 are at an elevated pressure thus reducing or eliminating the need for product compression. Column 55 can operate at the elevated pressure with high recovery of the products because no part of the compressed feed need be expanded to generate refrigeration or for other purposes and thereby the liquid reflux is maximized. Within elevated pressure column 55 the fluids fed into the column are separated by cryogenic rectification into oxygen-rich and nitrogen-rich fluids. Nitrogen-rich vapor may be removed from the upper portion of column 55 as stream 22, warmed by passage through heat exchanger 61, further warmed by passage through primary heat exchanger 53 and recovered as elevated pressure product nitrogen gas 29. In the embodiment illustrated in FIG. 1, the elevated pressure nitrogen product 29 is further compressed through compressor 66 and recovered as part of higher pressure product nitrogen 32. The product nitrogen will generally have a purity of at least 99 percent.

Oxygen-rich vapor may be removed from the lower portion of column 55 as stream 20 warmed by passage through primary heat exchanger 53 and recovered as elevated pressure product oxygen gas 28. In the embodiment illustrated in FIG. 1, the elevated pressure oxygen product 28 is further compressed through compressor 65 and recovered as higher pressure oxygen product 31. If desired, liquid oxygen product may also be recovered by withdrawing a stream of oxygen-rich liquid from column 55 as illustrated by stream 14. The product oxygen will generally have a purity of at least 95 percent.

Nitrogen-containing fluid at an elevated pressure is withdrawn from the upper portion of elevated pressure column 55, preferably at an intermediate point. By "intermediate point" it is meant below the top of the column. Generally, the nitrogen-containing fluid will have a nitrogen concentration within the range of from 90 to 99.99 percent and may be either waste or product nitrogen. The withdrawn nitrogen-containing fluid such as is shown by stream or conduit 21 is warmed by passage through heat exchanger 61 and then introduced into primary heat exchanger 53. A first portion 33 of the elevated pressure nitrogen completely traverses primary heat exchanger 53. This stream is passed through the purifier adsorbent bed to regenerate the adsorbent by taking up the adsorbed contaminants and removing them from the bed in effluent stream 37. The elevated pressure of the nitrogen provides it with sufficient driving force to effectively pass through and regenerate the purifier adsorbent bed.

A second portion 25 of the elevated pressure waste nitrogen is removed from heat exchanger 53 after partial traverse and is turboexpanded through turboexpander 63 thus generating refrigeration. The turboexpanded stream 26 is then passed through primary heat exchanger 53 thus serving to cool the feed and put refrigeration into the column system to drive the cryogenic rectification. The resulting warmed nitrogen 30 may be passed out of the system as stream 38. Some or all of stream 38, as shown by stream 35, may be passed through the purifier adsorbent bed to regenerate the adsorbent in addition to or in place of stream 33. Even after the turboexpansion, owing to the elevated pressure of the stream taken from the elevated pressure column, there is enough residual pressure in stream 35 to drive through the purifier bed and effectively regenerate the adsorbent. If desired, there need not be any flow in stream 33 and the entire elevated pressure stream from the upper portion of column 55 may be passed through stream 25 to turboexpander 63.

The purifier adsorbent bed is effectively regenerated by a small amount of fluid. For example, the elevated pressure nitrogen-containing stream flowrate need not exceed about 20 percent of the flowrate of the feed. Thus, the second column can operate at a higher pressure without the burden of requiring a large waste stream to be withdrawn for regeneration purposes and thereby more product nitrogen may be produced from the second column.

Turboexpander 63 will preferably be connected to a loading device, such as generator 64 shown in FIG. 1, in order to capture the energy generated by turboexpander 63.

As mentioned earlier, the embodiment of the invention illustrated in FIG. 1 includes an argon column. The argon column may be employed when the feed includes argon such as when the feed is air. In this embodiment, a stream 15 containing oxygen and argon is withdrawn from second column 55 and passed into argon column 57 wherein this argon column feed is separated by cryogenic rectification into argon-richer and oxygen-richer fluids. The oxygen-richer fluid is removed from argon column 57 and returned as stream 16 into elevated pressure column 55. Argon-richer fluid is passed as stream 17 into top condenser 62 wherein it is partially condensed against oxygen-enriched fluid as was previously discussed. The resulting argon-richer fluid is passed into phase separator 43 from which argon-richer liquid is returned to column 57 as reflux stream 18, and from which gaseous stream 19 is removed and recovered as crude argon. Generally, the crude argon will have an argon concentration of at least 96.5 percent.

When an argon column is employed, a preferred embodiment of the invention employs packing, preferably structured packing, as the vapor-liquid contacting elements in the elevated pressure column 55, and trays, such as sieve trays, as the vapor-liquid contacting elements in the argon column 51. In this situation, it is preferred that the elevated pressure column use packing throughout the column and that the argon column use trays throughout the column. This arrangement is illustrated in a representational manner in FIG. 1.

Figure 4:
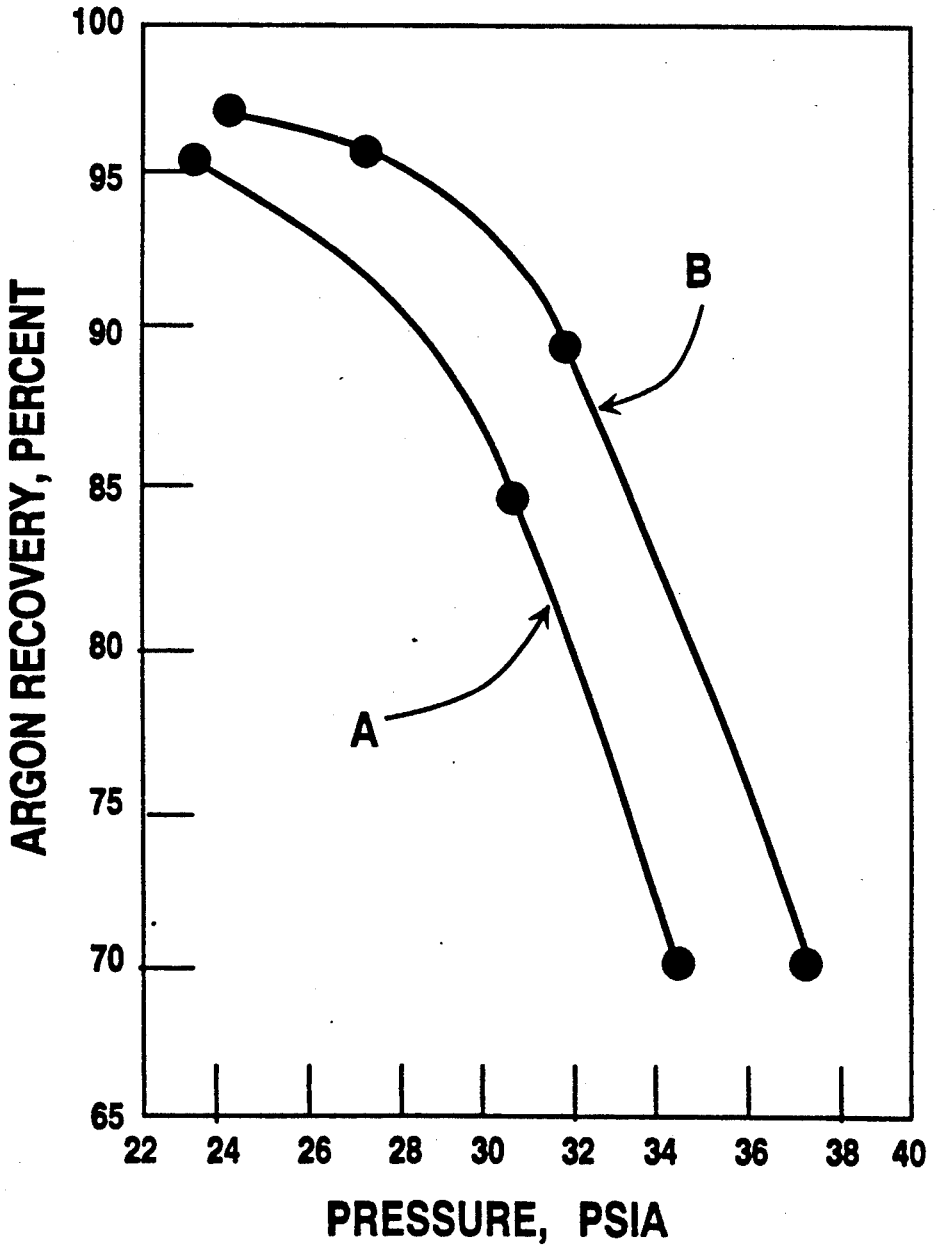
FIG. 4 is a graphical representation of advantages attainable with one preferred embodiment of the cryogenic rectification system of this invention.

The use of structured packing in the elevated pressure column allows a higher recovery of argon. Thus, the elevated pressure column can be operated at a higher pressure while still achieving an acceptable argon recovery when structured packing is utilized in the elevated pressure column. The benefit of reduced feed compressor power associated with the lower pressure drop of structured packing compared to sieve trays will also be realized. However, the argon column may be, and preferably is, fully trayed. The elevated pressure level of operation of the argon column means that the product crude argon stream will be sufficiently high in pressure, even when the column is trayed. There will generally be a satisfactory temperature difference for the condenser at the top of the argon column when the column is trayed An argon recovery improvement will be realized when sieve trays are used in the argon column rather than structured packing. This occurs because the average operating pressure of the column with trays is lower, and this improves the volatility of argon relative to oxygen This improved argon recovery is illustrated graphically in FIG. 4 wherein argon recovery as a percentage of the argon in the feed is shown on the vertical axis and the pressure of the elevated pressure column at the nitrogen withdrawal point, below the top of the column, is shown on the horizontal axis. Curve A is the argon recovery attainable when the elevated pressure column contains all trays and Curve B is the argon recovery attainable when the elevated pressure column contains all structured packing, while the argon column is fully trayed, for a range of elevated pressure column pressures. As can be seen from FIG. 4, at any given pressure, the argon recovery attainable with the arrangement of a fully packed elevated pressure column and a fully trayed argon column significantly exceeds that attainable with the conventional arrangement.

Figure 2:
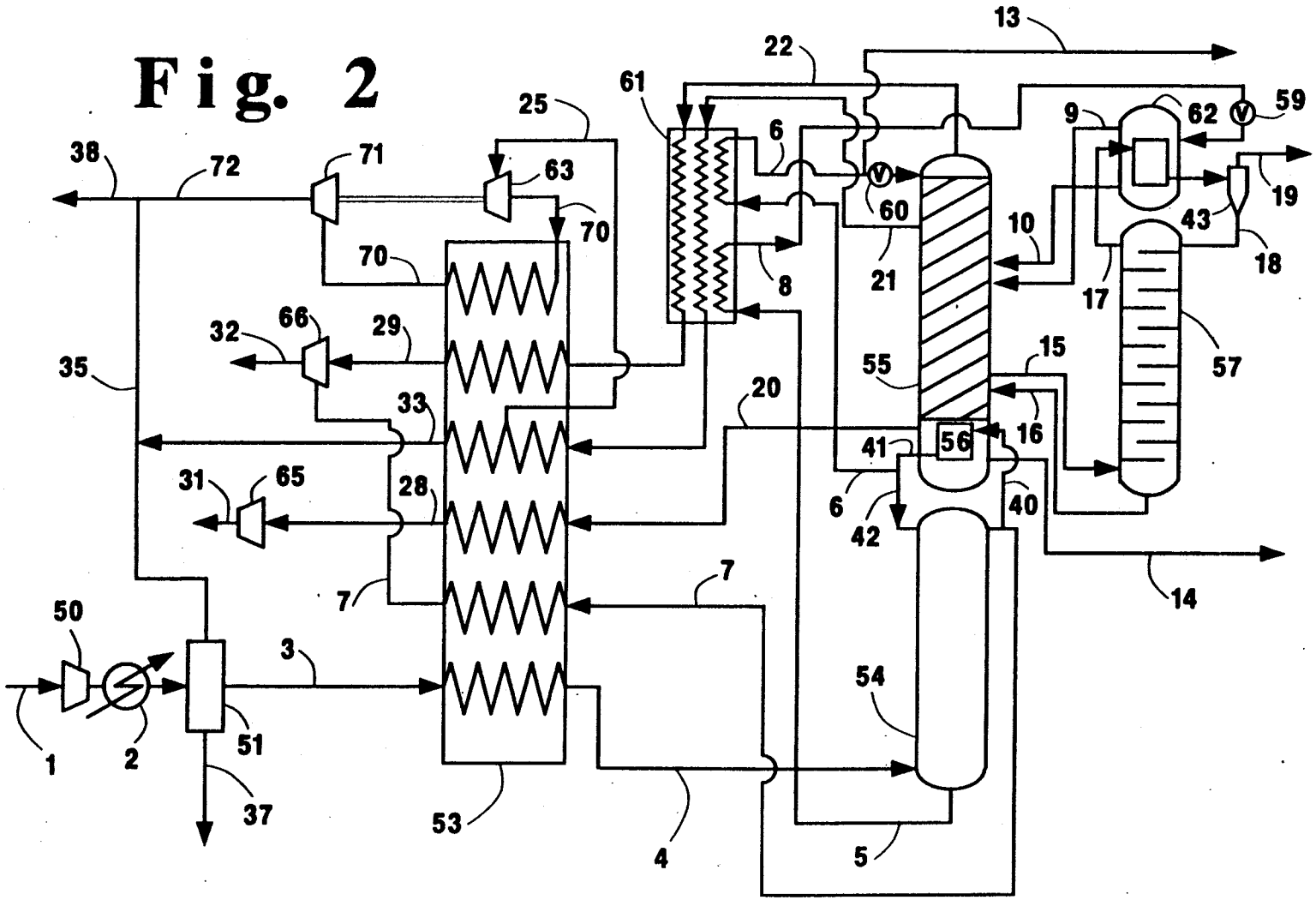
FIG. 2 is a schematic flow diagram of an embodiment of the invention employing a coupled turboexpander-compressor arrangement.
Figure 3:
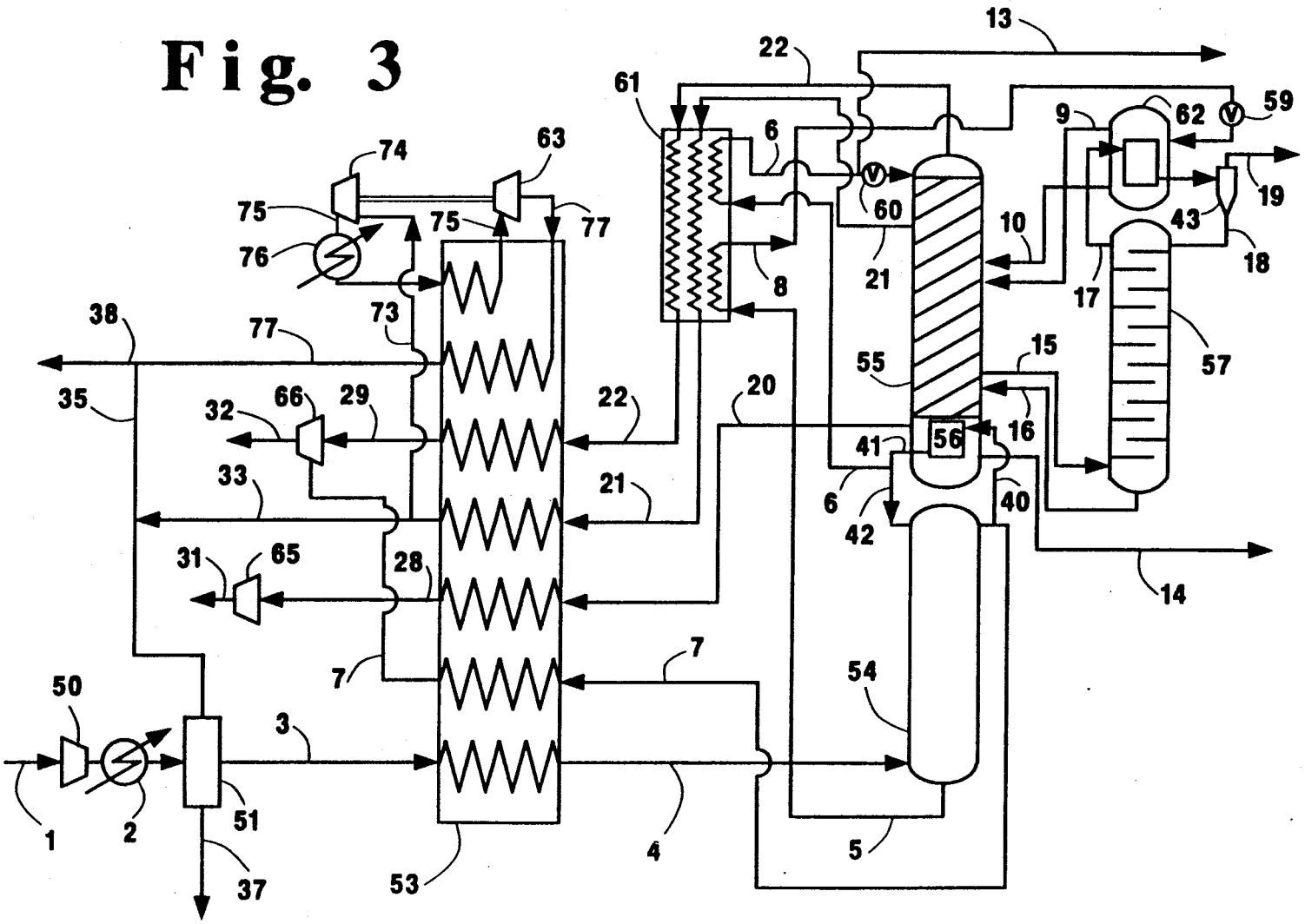
FIG. 3 is a schematic flow diagram of another embodiment of the invention employing a coupled turboexpander-compressor arrangement.

FIGS. 2 and 3 illustrate further embodiments of the invention wherein the turboexpander is coupled to a compressor that elevates the pressure of the nitrogen. The pressure level of the elevated pressure column will be reduced for a given product nitrogen rate and liquid product rate. This will yield a benefit in the argon production rate, thus allowing an increased product nitrogen rate and/or increased liquid rates while maintaining acceptable argon recovery. The numerals in FIGS. 2 and 3 correspond to those of FIG. 1 for the common elements and these common elements will not be discussed again in detail here.

Referring now to FIG. 2, nitrogen-containing portion 25 is expanded through turboexpander 63 to a very low level, usually below atmospheric pressure. This turboexpansion generates refrigeration. Resulting turboexpanded stream 70 is warmed by passage through primary heat exchanger 53 to cool the feed and is then compressed by compressor 71 which is coupled to and driven by turboexpander 63. The compressed stream 72 is thus at a pressure enabling it to exit the process or to drive through the purifier adsorbent bed for regeneration.

Referring now to the embodiment illustrated in FIG. 3, the entire nitrogen-containing stream 21 fully traverses primary heat exchanger 53. Thereafter, a portion 73 is compressed by compressor 74 which is coupled to and driven by turboexpander 63. The resulting compressed stream 75 is then cooled in aftercooler 76 and then in primary heat exchanger 53. Thereafter, stream 75 is turboexpanded through turboexpander 63 to generate refrigeration and the resulting stream 77 is warmed by passage through primary heat exchanger 53 to cool the feed. Stream 77 may then be released to the atmosphere or employed, in whole or in part, to regenerate the purifier adsorbent bed.

By the use of this invention, one can produce product oxygen and/or nitrogen at elevated pressure while reducing or eliminating product compression requirements. The invention employs the turboexpansion of a relatively small but elevated pressure nitrogen stream from the lower pressure column of a two column system to generate plant refrigeration thus avoiding the need to expand any of the feed. Moreover, the elevated pressure enables the nitrogen stream, even after turboexpansion, to effectively regenerate the feed purifier adsorbent beds. Preferably the turboexpanded fluid is employed to regenerate the bed although the regenerating stream may be from the upper portion of the elevated pressure column without going through a turboexpansion. In a preferred embodiment, an argon containing feed is processed and argon recovery is improved by employing an elevated pressure column comprising structured packing and an argon column comprising trays. Increased nitrogen production and/or increased liquid production while maintaining acceptable argon recovery can be achieved by coupling the nitrogen turboexpander to a compressor which elevates the pressure of the nitrogen.

Although the invention has been described in detail with reference to certain preferred embodiments, those skilled in the art will recognize that there are other embodiments of the invention within the scope and the spirit of the claims.

We claim:

1. A cryogenic rectification method for producing elevated pressure product comprising:

(A) passing a feed comprising oxygen and nitrogen through a purifier adsorbent bed and removing adsorbable contaminants from the feed to the bed to produce clean feed;

(B) cooling the clean feed, passing the cooled, clean feed into a high pressure column, and separating the feed by cryogenic rectification into nitrogen-enriched and oxygen-enriched fluids;

(C) passing nitrogen-enriched and oxygen-enriched fluids from the high pressure column into an elevated pressure column operating at a pressure less than that of the high pressure column but at least 20 psia, and producing nitrogen-rich and oxygen-rich fluids by cryogenic rectification in the elevated pressure column;

(D) removing nitrogen-containing fluid from the upper portion of the elevated pressure column, turboexpanding the nitrogen-containing fluid to generate refrigeration, and passing the resulting nitrogen-containing fluid in indirect heat exchange with the feed to cool the feed;

(E) passing nitrogen-containing fluid from the elevated pressure column through the purifier adsorbent bed to regenerate the bed; and (F) recovering at least one of the nitrogen-rich and oxygen-rich fluids from the elevated pressure column as elevated pressure product.

2. The method of claim 1 wherein the feed is air.

3. The method of claim 1 wherein the nitrogen-containing fluid used to regenerate the purifier adsorbent bed in step (E) is fluid which is turboexpanded in step (D).

4. The method of claim 1 wherein the nitrogen-containing fluid used to regenerate the purifier adsorbent bed in step (E) is not turboexpanded prior to the regeneration.

5. The method of claim 1 wherein the nitrogen-containing fluid is compressed prior to the turboexpansion.

6. The method of claim 1 wherein the nitrogen-containing fluid is compressed after the turboexpansion.

7. The method of claim 1 wherein the feed additionally comprises argon, further comprising passing argon-containing fluid from the elevated pressure column to an argon column and producing by cryogenic rectification an argon-richer fluid in the argon column.

8. The method of claim 7 wherein the cryogenic rectification in the elevated pressure column is carried out on vapor-liquid contacting elements comprising structured packing and the cryogenic rectification in the argon column is carried out on vapor-liquid contacting elements comprising trays.

9. The method of claim 1 wherein all of the feed which passes through the purifier adsorbent bed is passed into the high pressure column.

10. The method of claim 1 wherein the elevated pressure column is operating at a pressure of at least 25 psia.

11. A cryogenic rectification apparatus (A) a purifier adsorbent bed, a primary heat exchanger, and means for passing feed from the purifier adsorbent bed to the primary heat exchanger;

(B) a column system comprising a first column and a second column, means for passing feed from the primary heat exchanger into the first column and means for passing fluid from the first column into the second column;

(C) means for withdrawing fluid from the upper portion of the second column;

(D) a turboexpander, means for passing fluid withdrawn from the upper portion of the second column to the turboexpander, and means for passing expanded fluid from the turboexpander through the primary heat exchanger;

(E) means for passing fluid withdrawn from the upper portion of the second column to the purifier adsorbent bed; and (F) means for recovering product fluid from the second column.

12. The apparatus of claim 11 wherein the means for passing fluid withdrawn from the upper portion of the second column to the purifier adsorbent bed includes the turboexpander.

13. The apparatus of claim 11 wherein the means for passing fluid withdrawn from the upperportion of the second column to the purifier adsorbent bed does not include the turboexpander.

14. The apparatus of claim 11 wherein the turboexpander is coupled to a compressor.

15. The apparatus of claim 11 further comprising an argon column, means for passing fluid from the second column to the argon column, and means for recovering fluid from the argon column.

16. The apparatus of claim 15 wherein the second column has vapor-liquid contacting elements comprising structured packing and the argon column has vapor liquid contacting elements comprising trays.

* * * * *

UNITED STATES PATENT AND TRADEMARK OFFICE

CERTIFICATE OF CORRECTION

PATENT NO. : 5,197,296

DATED : March 30, 1993

INVENTOR(S) : N. M. Prosser, et al.

It is certified that error appears in the above-identified patent and that said Letters Patent is hereby corrected as shown below:

COLUMN 9

In claim 11, line 1 after "apparatus" insert --comprising-- .

Signed and Sealed this

Twenty-third Day of November, 1993

*Attest:*

*Attesting Officer*

Bruce Lehman

BRUCE LEHMAN

*Commissioner of Patents and Trademarks*